US007712680B2

(12) United States Patent
Berger et al.

(10) Patent No.: US 7,712,680 B2
(45) Date of Patent: May 11, 2010

(54) ULTRASONIC ATOMIZING NOZZLE AND METHOD

(75) Inventors: Harvey L. Berger, Hyde Park, NY (US); Donald F. Mowbray, Burnt Hills, NY (US); Randy A. Copeman, Glenford, NY (US); Robert J. Russell, Kingston, NY (US)

(73) Assignee: Sono-Tek Corporation, Milton, NY (US)

( * ) Notice: Subject to any disclaimer, the term of this patent is extended or adjusted under 35 U.S.C. 154(b) by 496 days.

(21) Appl. No.: 11/341,616

(22) Filed: Jan. 30, 2006

(65) Prior Publication Data

US 2007/0176017 A1 Aug. 2, 2007

(51) Int. Cl.
*B05B 1/08* (2006.01)

(52) U.S. Cl. ..... 239/102.2; 239/600; 239/DIG. 19

(58) Field of Classification Search ..... 239/4, 239/102.1, 102.2, 600, DIG. 19; 347/68
See application file for complete search history.

(56) References Cited

U.S. PATENT DOCUMENTS

| | | | | |
|---|---|---|---|---|
| 3,765,606 | A | 10/1973 | Moss et al. | |
| 3,812,854 | A * | 5/1974 | Michaels et al. | 239/102.2 |
| 4,004,736 | A * | 1/1977 | George | 239/4 |
| 4,284,239 | A | 8/1981 | Ikeuchi | |
| 4,415,123 | A | 11/1983 | Ikeuchi | |
| 4,659,014 | A * | 4/1987 | Soth et al. | 239/102.2 |
| 4,790,479 | A * | 12/1988 | Matsumoto et al. | 239/102.2 |
| 4,850,534 | A * | 7/1989 | Takahashi et al. | 239/102.2 |
| 5,330,100 | A | 7/1994 | Malinowski | |
| 5,516,043 | A * | 5/1996 | Manna et al. | 239/4 |
| 5,687,905 | A | 11/1997 | Tsai | |
| 6,585,175 | B2 | 7/2003 | Takeuchi et al. | |
| 6,719,211 | B2 | 4/2004 | Takeuchi et al. | |
| 6,752,326 | B2 | 6/2004 | Hirota et al. | |
| 6,880,770 | B2 | 4/2005 | Jameson et al. | |
| 2004/0247776 | A1 | 12/2004 | Folestad et al. | |

FOREIGN PATENT DOCUMENTS

JP 05-200328 A 10/1993

OTHER PUBLICATIONS

Harvey L. Berger, Ph.D., "Ultrasonic Liquid Atomization" 1998, entire book, Partridge Hill Publishers, Hyde Park, New York.

* cited by examiner

*Primary Examiner*—Steven J Ganey
(74) *Attorney, Agent, or Firm*—Baker & Hostetler LLP

(57) ABSTRACT

An ultrasonic nozzle configured to form relatively small drops of liquid at relatively high rates. The nozzle includes two horns, at least one of which includes a ceramic material. The nozzle also includes one or more transducers that cause mechanical motion in at least one of the horns. In addition, a method of forming micrometer-scaled drops of liquid at relatively high rates is provided.

14 Claims, 4 Drawing Sheets

ULTRASONIC ATOMIZING NOZZLE AND METHOD

FIELD OF THE INVENTION

The present invention relates generally to nozzles and to methods used for forming small drops of liquid. More particularly, the present invention relates to ultrasonic nozzles and to methods of operating such nozzles.

BACKGROUND OF THE INVENTION

Ultrasonic atomization techniques are currently available for forming drops of liquid that have number median drop sizes ($d_{N,0.5}$) of slightly below 20 microns (i.e., approximately 17 or 18 microns). According to these techniques, a solid surface of a metallic nozzle is vibrated at an ultrasonic frequency. Then, a liquid is introduced onto the surface of the nozzle and forms a liquid film thereon.

Since the solid surface vibrates in a direction that is perpendicular to the surface the liquid film, the liquid film absorbs vibrational energy from the solid surface. As a result, standing waves (known as "capillary waves") form in the liquid film. These capillary waves form a rectangular grid of wave crests and troughs and, at relatively low amplitudes of a given vibrational frequency, the crests and troughs of the standing waves are uniformly distributed and stable. However, as the amplitude of the given vibrational frequency is increased, the distance between the crests and troughs of the capillary waves increases (i.e., the waves grow larger) until, at a critical amplitude, the waves become unstable and collapse.

As unstable waves collapse, drops of liquid are ejected from the crests of the waves. These drops are ejected at a low velocity in a direction that is normal to the vibrating, solid surface. The formation and ejection of these drops is referred to as "ultrasonic atomization."

The range of amplitudes over which atomization occurs at a given frequency is limited. As discussed above, when the amplitude of the vibration is below a critical level, the capillary waves are stable and no appreciable amount of liquid is ejected from the crests of the waves. On the other hand, when the amplitude is too far above the critical level, cavitation occurs, wherein relatively large amounts of liquid are ejected at high velocities from the vibrating surface. Since cavitation is undesirable when relatively small drops of liquid are sought, when implementing currently-available ultrasonic atomization techniques, the amplitude of vibration is maintained within a relatively narrow range.

The peak-to-peak distance between any two adjacent crests in the above-discussed stable, capillary waves depends upon the frequency at which the solid surface vibrates. For example, adjacent crests form in closer proximity to each other at high frequencies than they do at lower frequencies. As such, when capillary waves become unstable and collapse, waves having adjacent crests that are closer together eject smaller drops of liquid than do waves having adjacent crests that are further apart from each other. Therefore, when the formation of relatively small drops of liquid is sought, it is often desirable to operate an ultrasonic atomization device at a relatively high frequency.

One currently-available ultrasonic atomization device that may be used to implement the above discussed techniques includes a nozzle that itself includes three principle active sections: an atomizing section (i.e., a front horn), a rear section (i.e., a rear horn) and an intermediate section. The front horn includes a solid, metallic vibrating surface where atomization takes places. The rear horn is configured to be connected to a source of liquid to allow the liquid to enter the nozzle. The intermediate section, which is positioned between the front horn and the rear horn, includes two piezoelectric transducers. When in operation, these transducers cause the atomizing surface on the front horn to vibrate at an ultrasonic frequency. More specifically, the transducers convert high-frequency electrical energy from an external power source into high-frequency mechanical motion that is transferred to the atomizing surface in order to cause the vibration thereof.

The transducers in currently-available ultrasonic atomization devices are disk-shaped and made from zirconate-titanate ceramics. Also, silver-plated or nickel-plated copper electrodes are used to introduce high-frequency electrical energy into the currently-available nozzle.

The front and rear horn of the currently-available nozzle are each fabricated from a Ti-6Al-4V titanium alloy. However, like all metal-based nozzles, this alloy has a plurality of shortcomings when it comes to forming small drops of liquid via ultrasonic atomization techniques. For example, the number median drop size ($d_{N,0.5}$) of the drops formed has a lower limit of approximately 17 or 18 microns. Also, the maximum flow rate of the liquid from which such small drops may be formed has an upper limit of approximately 10 gallons per hour (i.e., 600 ml per minute).

At least in view of the above, it would be desirable to provide nozzles and methods capable of forming drops of liquid having a number median drop size below 17 or 18 microns. It would also be desirable to provide nozzles and methods capable of forming such drops while maintaining flow rates of above 10 gallons per hour.

SUMMARY OF THE INVENTION

The foregoing needs are met, to a great extent, by certain embodiments of the present invention. According to one embodiment, a nozzle is provided. The nozzle includes an interface section configured to allow introduction of a liquid into the nozzle. The nozzle also includes an atomizing section that itself includes a ceramic material. The atomizing section is configured to form drops of the liquid having number median drop sizes of less than approximately 20 microns. The nozzle further includes an intermediate section positioned between the rear section and the atomizing section. The intermediate section is configured to promote ultrasonic-frequency mechanical motion in the atomizing section.

According to another embodiment of the present invention, a method of atomizing a liquid is provided. The method includes coating a portion of a ceramic surface with a liquid. The method also includes mechanically moving the surface at an ultrasonic frequency. The method further includes forming drops of the liquid having number median drop sizes of less than approximately 20 microns.

According yet another embodiment of the present invention, another nozzle is provided. The nozzle includes means for interfacing with a source of a liquid. The nozzle also includes means for forming drops of the liquid having number median drop sizes of less than approximately 20 microns, wherein the means for forming includes a ceramic material. The nozzle further includes means for promoting ultrasonic-frequency mechanical motion in the atomizing means, wherein the means for promoting is positioned between the means for interfacing and the means for forming.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
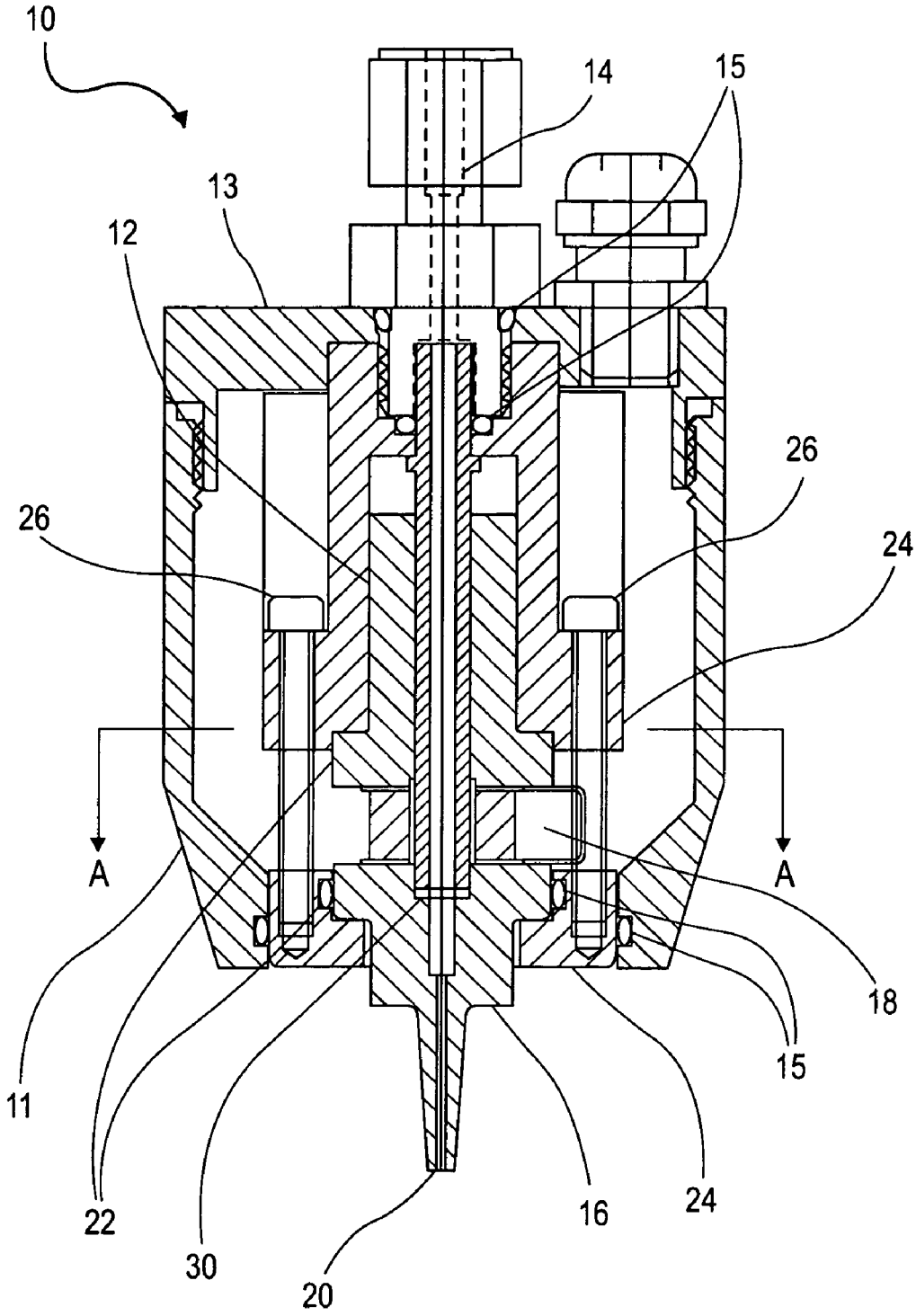
FIG. 1 is a longitudinal cross-sectional view of a ceramic-containing ultrasonic atomizing nozzle arrangement according to a first embodiment of the present invention.

The invention will now be described with reference to the drawing figures, in which like reference numerals refer to like parts throughout. FIG. 1 is a longitudinal cross-sectional view of a ceramic-containing ultrasonic atomizing nozzle arrangement 10 according to a first embodiment of the present invention. However, before further discussing the drawing figures any further, a few scientific principles related to ultrasonic atomization are briefly reviewed below.

Ceramic materials (e.g., SiC and $Al_2O_3$) differ from metals (e.g., titanium and titanium alloys) in a number of ways. For example, in some ceramic materials, such as silicon carbide (SiC) and aluminum oxide ($Al_2O_3$), the characteristic velocity at which sound waves propagate through these materials is considerably greater than the characteristic velocity at which sound waves propagate through any metallic material that is practical for use in constructing an ultrasonic atomizing nozzle. For example, SiC can be manufactured such that the characteristic velocity of sound therein is between 2.3 and 2.7 greater than the characteristic velocity of sound in a Ti-6Al-4V titanium alloy.

When implementing an ultrasonic atomization method according to certain embodiments of the present invention, capillary waves are produced in a liquid coating that is present on a solid surface that is vibrating at an ultrasonic frequency. Under such conditions, the number median drop size ($d_{N,0.5}$) of the drops formed is calculated as follows:

$$d_{N,0.5}=0.34(8\pi s/\rho f^2)^{1/3},$$

where f=the operating frequency of the nozzle, ρ=the density of the liquid coating the surface and s=the surface tension of the liquid. Hence, as the operating frequency, f, increases, the number median drop size ($d_{N,0.5}$) decreases.

In order to form capillary waves that are suitable for ultrasonic atomization, it is desirable to suppress the formation of waves that are not perpendicular to the solid surface from which the liquid film absorbs vibrational energy. In order to suppress the formation of such non-perpendicular waves, the largest diameter of any active nozzle element is limited. More specifically, the diameter is limited to a length that is below one-fourth of the wavelength, λ, of an acoustic wave in the material from which the atomizing surface is formed.

The wavelength, λ, of an acoustic wave in such a material is calculated as follows:

$$\lambda=c/f,$$

where c=the characteristic velocity at which sound waves propagate through a ceramic material. Thus, for a given operational frequency, materials having higher characteristic velocities, c, at which sound waves propagate therethrough correspond to longer wavelengths. Hence, such materials allow for a larger nozzle diameter at a given frequency.

When the diameter of the nozzle becomes so small that the nozzle becomes impractical to make or use, the practical operating frequency of the nozzle is reached. As such, in metallic nozzles according to the prior art (i.e., in nozzles where the vibrating surface is metallic), the practical upper limit of the operating frequency, f, is approximately 120 kHz. However, in nozzles according to embodiments of the present invention where ceramics are used, the upper limit of the operating frequency, f, is raised to approximately 250 kHz. Thus, for a given liquid, $d_{N,0.5}$ is reduced by a factor of $(120/250)^{2/3}=0.61$.

Keeping in mind the above-mentioned characteristics of ceramic materials, one of skill in the art will appreciate that, at a given operating frequency, f, ceramic nozzles can be operated at a greater flow rate than their metallic counterparts. In other words, the diameter of the nozzle can remain larger in a ceramic nozzle than in a metallic nozzle, as can stems, the area of the atomizing surface, and/or liquid feed orifices that may be included to lead liquid to the nozzle.

As mentioned above, FIG. 1 is a longitudinal cross-sectional view of an ultrasonic atomizing nozzle arrangement 10 according to a first embodiment of the present invention. The nozzle 10 illustrated in FIG. 1 includes a rear horn 12 that functions as an interface section. As such, the rear horn 12 is configured to allow the introduction of a liquid into the nozzle 10.

The rear horn 12 illustrated in FIG. 1 is directly connected to a liquid inlet 14. However, the rear horn 12 may be directly or indirectly connected to any component that will allow for flow of a liquid into the nozzle 10. The liquid inlet 14 may be affixed to the rear horn 12 in any manner that would become apparent to one of skill in the art upon practicing the present invention (e.g., a pressure seal or an adhesive). Although not illustrated in FIG. 1, the liquid inlet 14 is typically connected, either directly or indirectly, to a source of liquid such as, for example, a tank containing water or an organic solvent.

According to certain embodiments of the present invention, the rear horn 12 is either made entirely from a ceramic material or portions of the rear horn 12 are made from a ceramic material. However, according to other embodiments of the present invention, the rear horn 12 is fabricated either partially or entirely from a metal. For example, the rear horn 12 may be made from silicon carbide (SiC) or aluminum oxide ($Al_2O_3$).

The nozzle 10 illustrated in FIG. 1 also includes a front horn 16 that is configured to function as an atomizing section.

The front horn 16, according to certain embodiments of the present invention, can include one or more portions made from a ceramic material (e.g., SiC or $Al_2O_3$) or can be made entirely from one or more ceramic materials. The front horn 16 is configured to form drops of the liquid introduced into the nozzle 10 through the rear horn 12. These drops can, according to certain embodiments of the present invention, have number median drop sizes ($d_{N,0.5}$) of less than approximately 20 microns (e.g., approximately 17 microns), although larger drop sizes are also within the scope of certain embodiments of the present invention. Also, according other embodiments of the present invention, the front horn 16 is configured to form drops of liquid having number median drop sizes of between approximately 7 microns and approximately 10 microns.

One of the advantages of the nozzle 10 illustrated in FIG. 1 is that it increases the rate at which a liquid introduced into the nozzle 10 may be atomized. As discussed above, because the ceramic material used in embodiments of the present invention have higher characteristic velocities at which sound waves propagate therethrough, a larger front nozzle diameter is allowable for a given frequency. Therefore, according to certain embodiments of the present invention, the front horn 16 is configured to allow the liquid introduced into the nozzle 10 to flow through the nozzle 10 at a rate above approximately 600 ml per minute (10 gallons per hour). According to other embodiments of the present invention, the front horn 16 is configured to allow the liquid to flow through the nozzle 10 and the front horn 16 at a rate of approximately 1200 ml per minute (20 gallons per hour).

In the nozzle 10 illustrated in FIG. 1, the rear horn 12 and the front horn 16 have substantially equal lengths. However, according to other embodiments of the present invention, the rear horn 12 and the front horn 16 have different lengths. According to certain embodiments of the present invention, a ceramic nozzle operates at 250 kHz and the rear horn 12 and front horn 16 both have lengths equal to, for example, $3\lambda/4$, since horns of such length are substantially easier to manufacture than horns having lengths of $\lambda/4$. According to certain other embodiments of the present invention, a ceramic nozzle operates at 120 kHz and both horns 12, 16 have lengths of $\lambda/4$, which are relatively practical to manufacture.

The nozzle 10 illustrated in FIG. 1 also includes a transducer portion 18 that includes a pair of transducers that are positioned in an intermediate section of the nozzle 10 that is located between the rear horn 12 and the front horn 16. The transducers in the transducer portion 18 are piezoelectric transducers and are configured to promote ultrasonic-frequency mechanical motion in the front horn 16. In other words, the transducers in the transducer portion 18 provide the mechanical energy to cause the atomizing surface 20 located on the front horn 16 illustrated in FIG. 1 to vibrate at an ultrasonic frequency with sufficient amplitude to result in atomization. Although two transducers are discussed above as being included in the transducer portion 18 illustrated in FIG. 1, a single transducer and/or any other component or system that can be used to cause ultrasonic-frequency mechanical motion in the front horn 16 is also within the scope of the present invention.

The rear horn 12 and the front horn 16 each include a flange 22. A cover, in the form of a ring 24, is positioned adjacent to each of the flanges 22 illustrated in FIG. 1. A plurality of fasteners, in the form of bolts 26, are also illustrated in FIG. 1 and connect the two rings 24.

The above-discussed bolts 26 and rings 24 are components of a clamping mechanism that is positioned adjacent to the exterior surfaces of the rear horn 12 and front horn 16, respectively. This clamp is configured to keep the front horn 16 and the rear horn 12 adjacent to the transducer portion 18. In addition, this clamp is also configured to apply predetermined compressive forces to the transducer/horn assembly, thereby assuring proper mechanical coupling amongst the various elements of the assembly.

By using the clamp arrangement illustrated in FIG. 1, the rear horn 12 and the front horn 16, one or both of which may be made from a ceramic material, do not need to include threaded holes that directly accommodate the bolts to be kept adjacent to each other. This reduces the likelihood that either the rear horn 12 or the front horn 16 will crack as threaded holes are formed therein or that the ceramic threads formed in such holes will lack the shear strength to sustain the amounts of pressure to which they may be subjected (e.g., over 10,000 psi).

Also illustrated in FIG. 1 are a front shroud 11, a rear shroud 13 and a plurality of O-rings 15. Together, the front shroud 11 and the rear shroud 13 provide a housing for the nozzle 10 and the O-rings 15 provide a plurality of seals within this housing.

Figure 2:
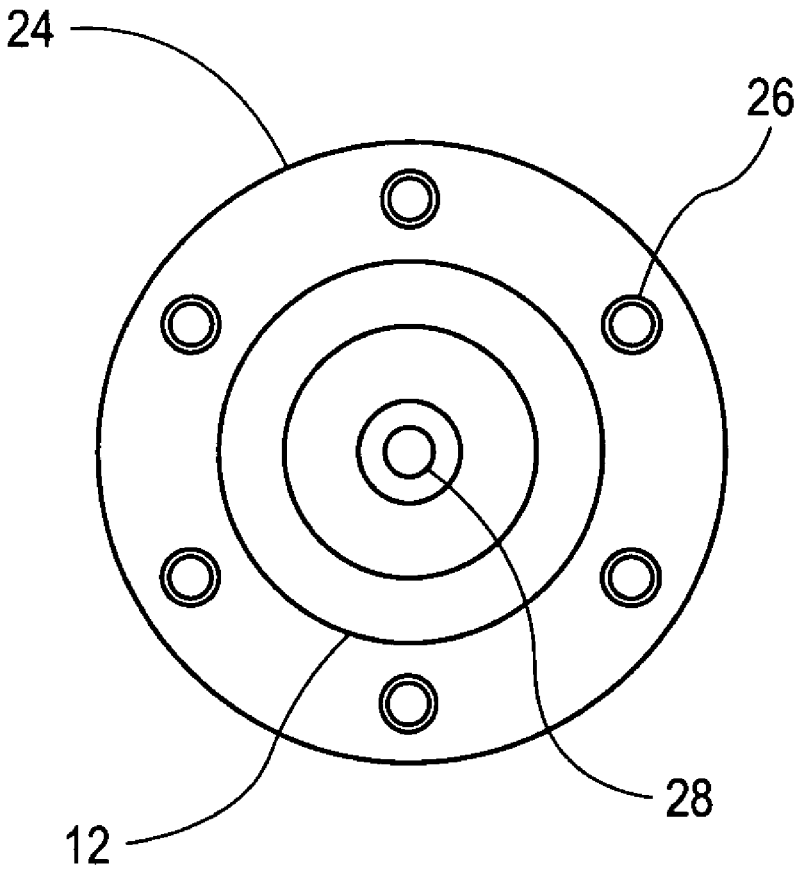
FIG. 2 illustrates a radial cross-section of the ultrasonic atomizing nozzle arrangement illustrated in FIG. 1 taken along line A-A.

FIG. 2 illustrates a radial cross-section of the ultrasonic atomizing nozzle arrangement 10 illustrated in FIG. 1 taken along line A-A. As illustrated in FIG. 2, the rear horn 12 has a fluid inlet 28 at the center thereof. This fluid inlet 28 is part of the liquid conduit 30 illustrated in FIG. 1 that allows liquid to travel from the liquid inlet 14 all the way to the atomizing surface 20 on the front horn 16.

As also illustrated in FIG. 2, the ring 24 extends around the rear horn 12 and has a plurality of bolts 26 positioned at various locations about the circumference thereof. Although a ring 24 is illustrated in FIG. 2 as making up a portion of the above-discussed clamp, other components may be positioned adjacent to the flanges 22 illustrated in FIG. 1. For example, square or rectangular plates may be used. Also, although six regularly spaced bolts 26 are illustrated around the periphery of the ring 24 in FIG. 2, other distributions of one or more bolts 26 or other fasteners may be used according to other embodiments of the present invention.

Figure 3:
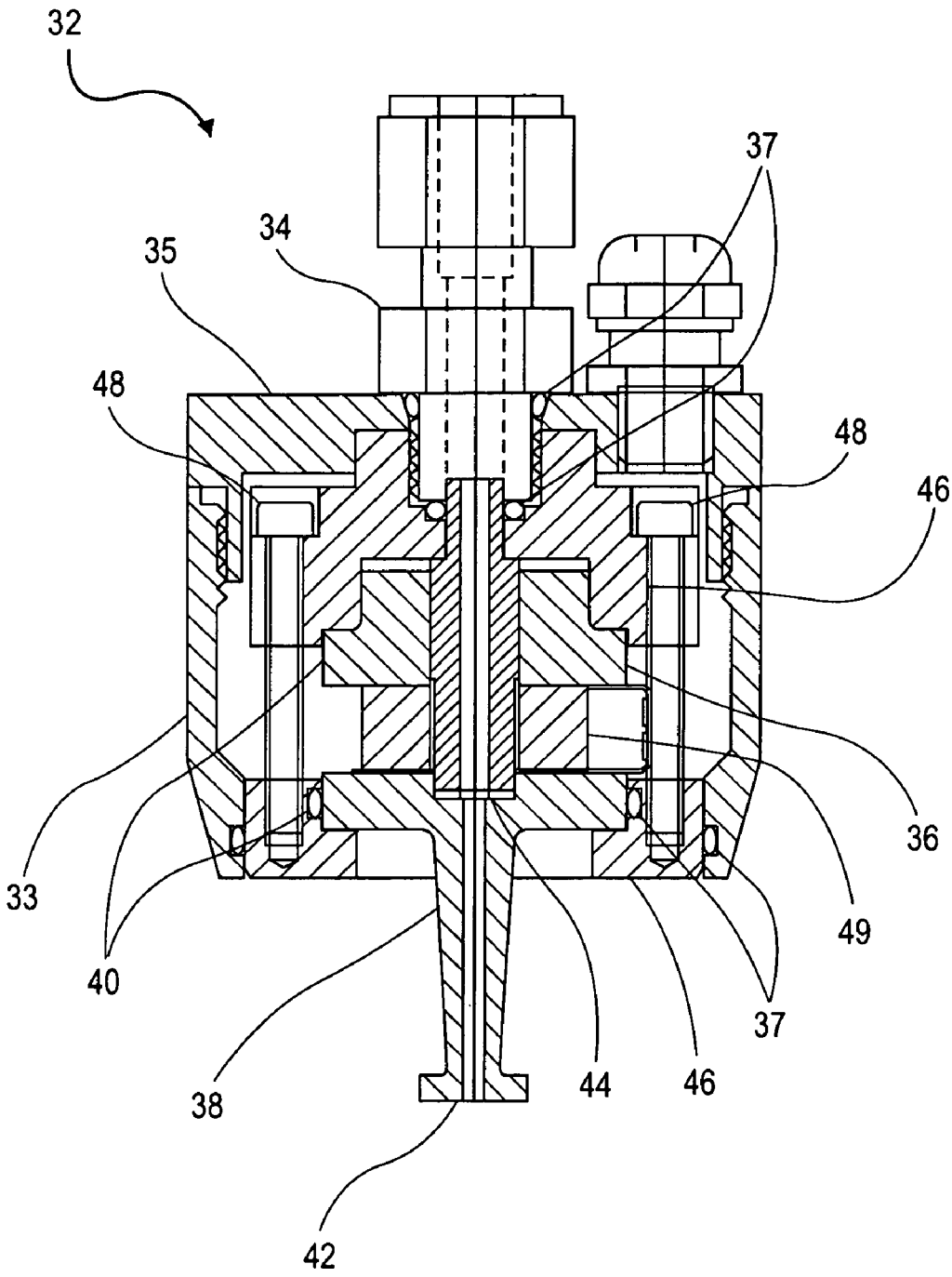
FIG. 3 is a longitudinal cross-sectional view of a ceramic-containing ultrasonic atomizing nozzle arrangement according to a second embodiment of the present invention.

FIG. 3 is a longitudinal cross-sectional view of an ultrasonic atomizing nozzle arrangement 32 according to a second embodiment of the present invention. Like the nozzle 10 illustrated in FIG. 1, the nozzle 32 illustrated in FIG. 3 includes a liquid inlet 34, a rear horn 36 and a front horn 38, each having a flange 40. The front horn 38 also includes an atomizing surface 42 that is positioned at one end of a liquid conduit 44. In addition, the nozzle 32 illustrated in FIG. 3 includes a clamp arrangement that includes a plurality of rings 46 and bolts 48. Further, the nozzle 32 also includes a transducer portion 49 that includes a pair of transducers that are positioned in an intermediate section of the nozzle 32 that is located between the rear horn 36 and the front horn 38. Also illustrated in FIG. 3 are a front shroud 33 and a rear shroud 35 that, together, provide a housing for the nozzle 32 and a plurality of O-rings 37 that provide a plurality of seals within this housing.

One way in which the nozzle 32 illustrated in FIG. 3 differs from the nozzle 10 illustrated in FIG. 1 is that the front horn 38 illustrated in FIG. 3 is approximately 3 times a long as the rear horn 36 illustrated therein. This is particularly representative of the fact that the rear horn 12 and front horn 16 may, according to certain embodiments of the present invention, have different lengths. In fact, according to certain other embodiments of the present invention, the respective lengths of the rear horn and front horn in a given nozzle are multiples or fractions of each other. As mentioned above, under certain operating conditions (e.g., high frequencies), it becomes impractical to manufacture horns having lengths equal to $\lambda/4$.

Therefore, horns having lengths equal to multiples of $\lambda/4$ are often used under such circumstances.

Figure 4:
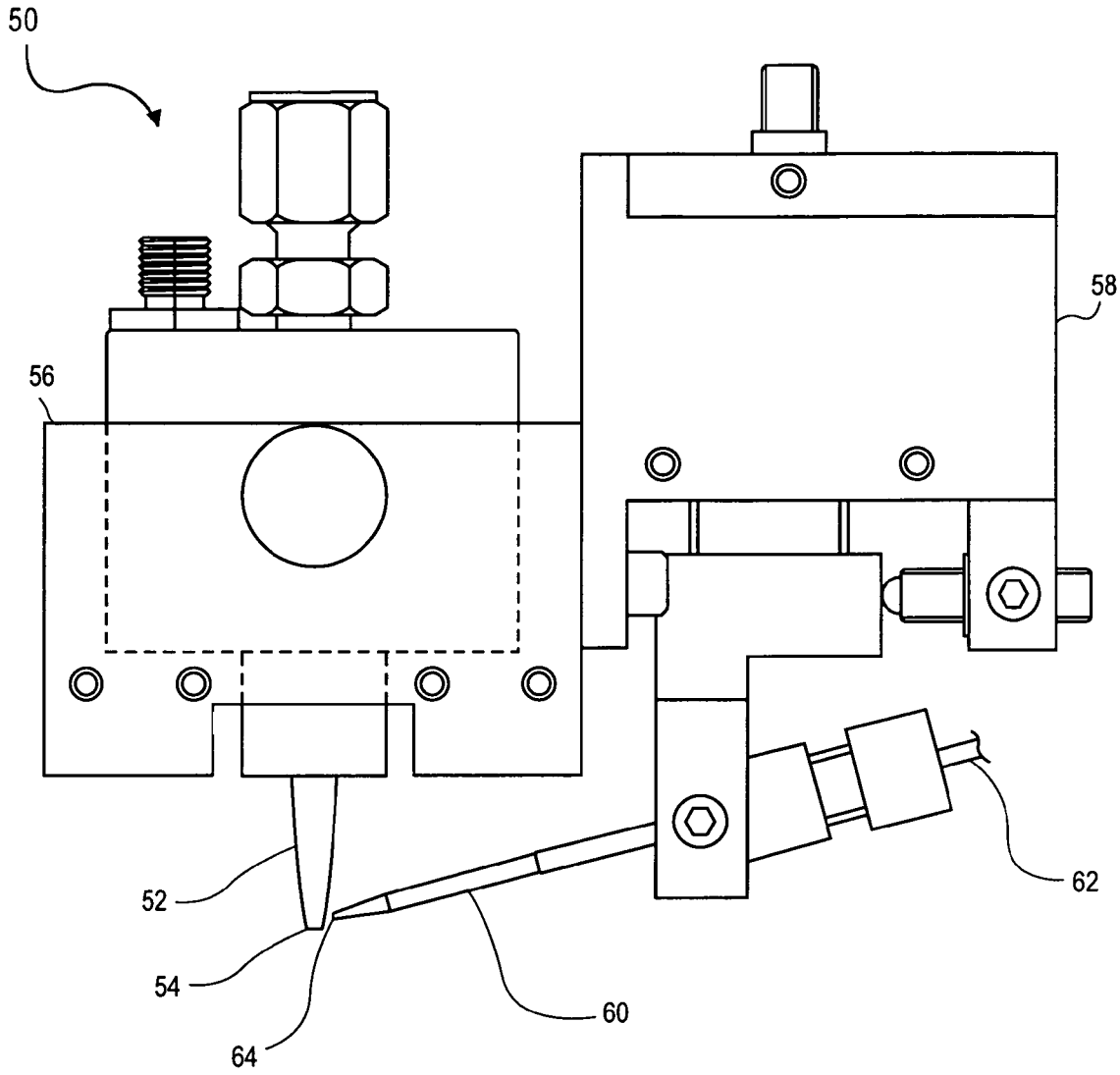
FIG. 4 is a side view of a ceramic-containing ultrasonic atomizing nozzle arrangement according to a third embodiment of the present invention.

FIG. 4 is a side view of a ceramic-containing ultrasonic atomizing nozzle 50 arrangement according to a third embodiment of the present invention. Although only a front horn 52 and an atomizing surface 54 are illustrated in FIG. 4, the nozzle 50 illustrated in FIG. 4 also includes a rear horn, flanges, transducers and other components analogous to the components included in the nozzles 10, 32 illustrated in FIGS. 1-3. However, the nozzle 50 illustrated in FIG. 4 sits in a nozzle holder 56 that is positioned adjacent to a probe adjuster and holder 58. In turn, the probe adjuster and holder 58 is connected to a liquid delivery probe 60 that delivers liquid from a liquid input 62 to the atomizing surface 54. In other words, whereas liquid in the nozzles 10, 32 illustrated in FIGS. 1-3 traveled through the centers thereof before reaching the atomizing surfaces 20, 42, the nozzle 50 illustrated in FIG. 4 has liquid delivered directly to the atomizing surface 54 from a source exterior to the nozzle 50 (i.e., liquid delivery probe 60).

Typically, an exit point 64 of liquid delivery probe 60 is positioned within a few thousandths of an inch and to the side of atomizing surface 54. However, according to certain embodiments of the present invention, particularly those used to atomize liquid metals, the exit point 64 is located substantially directly above the atomizing surface 54.

According to yet another embodiment of the present invention, a method of atomizing a liquid is provided. The method includes coating a portion of a ceramic surface (e.g., the atomizing surface 20 illustrated in FIG. 1) with a liquid. According to certain embodiments of the present invention, this coating step includes introducing the liquid onto the surface at a rate of between approximately 600 ml/minute (i.e., 10 gal/hour) and approximately 1200 ml/minute (i.e., 20 gal/hour).

The method also includes mechanically moving (i.e., vibrating) the surface at an ultrasonic frequency. According to certain embodiments of the present invention, this mechanically moving step includes mechanically moving the surface at a frequency of between approximately 120 kHz and approximately 250 kHz. According to other embodiments of the present invention, the mechanically moving step includes mechanically moving the surface at a frequency of between approximately 25 kHz and less than approximately 120 kHz (e.g., approximately 60kHz).

The above-discussed method also includes forming drops of the liquid having number median drop sizes of less than approximately 20 microns. According to certain embodiments of the present invention, the coating step comprises selecting liquids containing an organic solvent. According to these embodiments, the number median drop size of the drops formed during the above-discussed forming step is between approximately 7 microns and approximately 10 microns.

The above-discussed method also includes passing the liquid through an interface section that includes a ceramic material before performing the coating step. This passing step may be performed, for example, by passing liquid through either the rear horn 12 or the front horn 16 illustrated in FIG. 1, so long as at least one of these horn 12, 16 has a ceramic material incorporated therein.

According to other embodiments of the present invention, the above-discussed method includes clamping the interface section to an atomizing section that includes the ceramic surface. This clamping step is typically an alternative to having to use fasteners that would have to be screwed directly into components of a nozzle used to implement the above-discussed method.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An ultrasonic atomizing nozzle, comprising:

a ceramic rear horn including a flanged lower end and a central bore;

a ceramic front horn including a flanged upper end, a central bore, and a tapered lower end terminating in a flat tip having an atomizing surface surrounding a central opening;

a transducer assembly, including at least one ultrasonic transducer, disposed between the ceramic rear horn and the ceramic front horn; and a clamp assembly, including a rear ring having a shoulder that accommodates the flanged lower end of the ceramic rear horn, a front ring having a shoulder that accommodates the flanged upper end of the ceramic front horn, and a plurality of fasteners that connect the front ring and the rear ring to mechanically couple the ceramic rear horn, the transducer assembly and the ceramic front horn to one another.

2. The nozzle of claim 1, wherein the atomizing surface forms drops having a median drop size of less than 17 microns.

3. The nozzle of claim 2, wherein the drops have a median drop size of between 7 microns and 10 microns.

4. The nozzle of claim 2, wherein the ultrasonic transducer is a piezoelectric device that operates at a frequency of between 120 kHz and 250 kHz.

5. The nozzle of claim 2, wherein the atomizing surface forms drops a rate greater than 600 ml/min.

6. The nozzle of claim 5, wherein the atomizing surface forms drops a rate less than 1200 ml/min.

7. The nozzle of claim 1, wherein the length of the ceramic front horn is substantially the same as the length of the ceramic rear horn.

8. The nozzle of claim 1, wherein the length of the ceramic front horn is approximately 3 times the length of the ceramic rear horn.

9. The nozzle of claim 1, wherein the fasteners are bolts.

10. The nozzle of claim 1, wherein the ceramic rear horn is substantially disposed within the rear ring, and a portion of the flanged upper end of the ceramic front horn is disposed within the front ring.

11. The nozzle of claim 1, further comprising a liquid inlet connected to the rear ring.

12. The nozzle of claim 11, further comprising a tube, extending through the central bore of the ceramic rear horn and the transducer assembly, to fluidically couple the liquid inlet to the central bore of the ceramic front horn.

13. The nozzle of claim 1, further comprising a housing, including a rear shroud and a front shroud, and a plurality of O-rings.

14. The nozzle of claim 1, wherein the flat tip has a flange.

* * * * *